US005657881A

United States Patent [19]

Fourel

[11] Patent Number: 5,657,881

[45] Date of Patent: Aug. 19, 1997

[54] ATTACHMENT DEVICE FOR LONG OBJECTS

[75] Inventor: Pascal Fourel, Saint Malo, France

[73] Assignee: Automaxi Industries, Saint Malo, France

[21] Appl. No.: 351,836

[22] Filed: Dec. 8, 1994

[30] Foreign Application Priority Data

Feb. 18, 1994 [FR] France ..... 94 01856

[51] Int. Cl.[6] ..... A47F 7/00

[52] U.S. Cl. ..... 211/60.1

[58] Field of Search ..... 211/60.1, 59.1, 211/113, 118

[56] References Cited

U.S. PATENT DOCUMENTS

| | | | |
|---|---|---|---|
| 947,016 | 1/1910 | Fowler | 211/113 X |
| 3,370,715 | 2/1968 | Kolozsvari | 211/60.2 X |
| 4,768,657 | 9/1988 | Lonow | 211/113 X |
| 5,351,346 | 10/1994 | Hodges, Jr. | 211/113 X |

FOREIGN PATENT DOCUMENTS

| | | |
|---|---|---|
| 2506148 | 5/1981 | France . |
| 2165144 | 4/1984 | United Kingdom . |
| 2228864 | 9/1990 | United Kingdom . |

*Primary Examiner*—Alvin C. Chin-Shue
*Assistant Examiner*—Sarah L. Purol
*Attorney, Agent, or Firm*—Juettner Pyle Lloyd & Piontek

[57] ABSTRACT

A device for attaching long objects, in particular bars, includes an element for attaching bars together and a tongue having hook means. The element for attaching the bars together includes four identical arms assembled in pairs at the ends of a central region. The hook means is an eyelet.

7 Claims, 2 Drawing Sheets

ATTACHMENT DEVICE FOR LONG OBJECTS

BACKGROUND OF THE INVENTION

1. Field of the Invention

The invention concerns an attachment device for long objects, intended in particular for display of roof racks in shelving units in stores.

2. Description of the Prior Art

Long objects or bars, especially roof rack bars, designed to be fitted to automobile vehicles to carry luggage or skis, are often sold in sets, a set of bars constituting a system of bars including two or more bars.

Ways of associating the bars to constitute sets and displaying these sets are familiar in the market place.

A first way is to join the bars together by elastic bands, by information labels in the form of strips, or by clips, and to place the bars horizontally on the (possibly inclined) shelves or their equivalents in shelving units in stores.

A second way is to package the bars in cardboard cartons and dispose the cartons horizontally or vertically.

Conventional horizontal shelving units have many drawbacks: the bottom 50 cm of the shelving unit is not very useful in practise, and the arrangement of the shelves must provide sufficient space between them for customers to choose and extract the sets of bars. The labels are easier to read on some shelves than on others.

Cardboard cartons enable a vertical disposition but this form of packaging is costly, raises recycling problems and deteriorates with handling.

It is also found that customers like to be able to see and touch the product they are intending to purchase and this type of packaging is ill suited to this practise.

An object of the invention is to overcome the above drawbacks by proposing a device for attaching bars together which is economical and enables vertical disposition on appropriate shelving.

SUMMARY OF THE INVENTION

The invention therefore consists in a device for attaching long objects, in particular bars, wherein it includes an element for attaching bars together and a tongue having hook means.

In a preferred embodiment of the invention the element for attaching the bars together includes four identical arms arranged in pairs at the ends of a central region so that:

- the main axis of the central region is orthogonal to the main axis of the tongue in a "use" position of said tongue,
- a first pair of arms at a first end of the central region has a main axis common to the two arms orthogonal to the main axis of said central region, said arms extending in opposite directions along said common main axis,
- a second pair of arms at a second end of the central region has a main axis common to the two arms orthogonal to the main axis of said central region, said arms extending in opposite directions along this common main axis which is parallel to the common main axis of the first pair of arms, the distance between these two parallel axes being determined by the distance along the main axis of the central region between the two ends of said central region of the attachment element.

In another preferred embodiment of the invention the tongue can rotate on the attachment element.

The hanging means is preferably an eyelet.

In accordance with the invention, the bars are attached together or hooked up by at least one such attachment device.

A shelving unit in accordance with the invention for bars attached by the above attachment devices includes a back in a vertical plane and at least one horizontal row of parallel spindles having a cross-section matching the eyelet of the attachment device, which supports are mounted on the vertical back in a direction which is substantially orthogonal to said back, their length in this direction enabling several sets of bars to be suspended from the same support, and said supports are spaced horizontally in such a way that the distance between two sets of bars suspended from adjacent supports of the same row is less than 5 cm.

Other features and advantages of the invention will emerge from the following description of the appended drawings.

DETAILED DESCRIPTION OF THE PREFERRED EMBODIMENT

Figure 1:
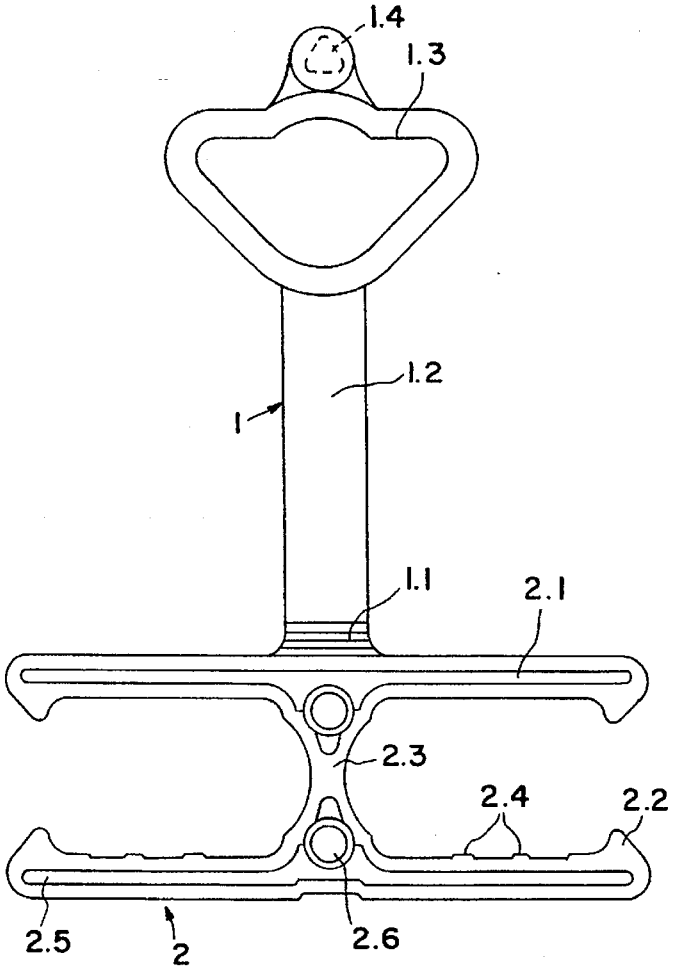
FIG. 1 is a front view of the attachment device of the invention.
Figure 2:
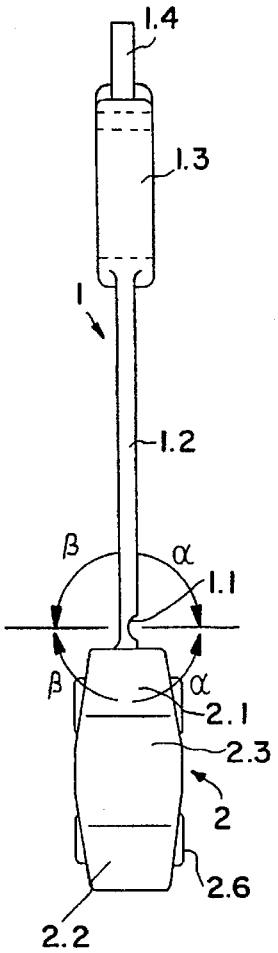
FIG. 2 is a side view of the device from FIG. 1.
Figure 3:
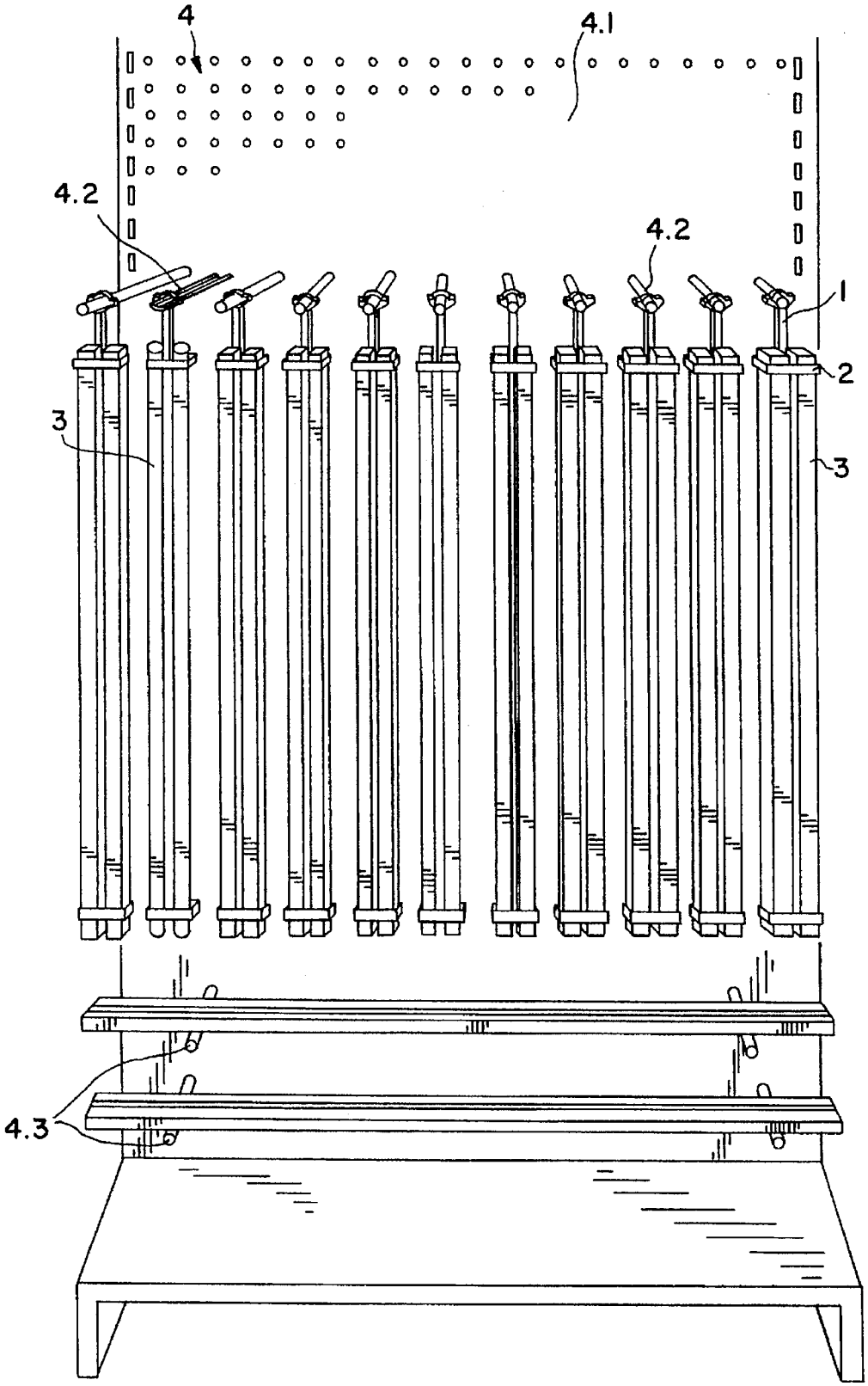
FIG. 3 is a front view of a shelving unit of the invention.

The attachment device of the invention shown by way of example in FIGS. 1 to 3 is specifically intended for joining together bars, in particular roof rack bars used on automobile vehicles, so that such bars can be transported and displayed on shelving units in stores.

Prior art roof rack bars have a 38 mm×20 mm oval cross-section or a 30 mm×20 mm rectangular cross-section.

The attachment device of the invention for bars to these specifications comprises a hook-on member or tongue 1 and an attachment element 2 for joining the bars together.

The tongue has a main leg 1.2 with an eyelet 1.3 at one end. A tab 1.4 which can carry information is disposed on the axis of the main leg 1.2, on the opposite side of the eyelet 1.3. The second end of the main leg is joined to the attachment element 2.

When the remainder of the description refers to horizontal and vertical directions, these are relative to a position of the attachment device in which it is suspended from its eyelet 1.3 and in which the attachment element 2 is therefore below the tongue 1. The thickness or depth direction is orthogonal to the vertical direction and is the direction in which the main leg 1.2 of the tongue 1 has the smallest dimension.

A triangular eyelet 1.3 is provided at the first end of the main leg 1.2 of the tongue 1. A support 4.2 fixed to a wall 4.1 of a shelving unit 4 is inserted in the eyelet 1.3.

The support 4.2 is usually either U-shape with each branch of the U-shape having a circular cross-section around 4 mm in diameter or cylindrical with a circular cross-section about 20 mm in diameter.

The eyelet 1.3 is triangular with rounded corners, two of the three corners of the triangle being on a horizontal line and the third corner below this horizontal line. The radius of curvature of the corners is matched to the cross-section of one branch of the U-shape of said support 4.2 and the distance between the two corners on the horizontal side of the triangle being matched to the distance between the two branches of the U-shape so that a support 4.2 can be inserted into the eyelet 1.3.

The triangular shape also enables insertion of a cylindrical support 4.2. The horizontal side of the triangle advantageously includes a curved central portion with the concave side facing towards the interior of the triangle and the bottom corner, also rounded, advantageously has the same curvature, which curvature is matched to the diameter of a cylindrical support cross-section so that a support 4.2 of this kind can be inserted in the eyelet 1.3.

An attachment element 2 is joined to the second end of the main leg 1.2 of the tongue 1.

The attachment element 2 has four identical arms 2.1 and a central region 2.3. The end of said main leg 1.2 is joined to a first end of the central region 2.3 from which extend two of the four arms 2.1.

This first pair of arms 2.1 is disposed at this first end of the central region 2.3 along a main axis common to the two arms 2.1 and orthogonal to the main axis of said central region 2.3. The free end portions 2.2 of said arms 2.1 extend in opposite directions along this common main axis.

The second pair of arms 2.1 is disposed at a second end of the central region 2.3 along a main axis common to the two arms 2.1 and orthogonal to the main axis of said central region 2.3. The free end portions 2.2 of said arms 2.1 extend in opposite directions from this common main axis which is parallel to the common main axis of the first pair of arms 2.1, the distance between these two parallel axes being determined by the distance along the main axis of the central region 2.3 between the two ends of said central region 2.3 of the attachment element 2.

One arm 2.1 of the first pair and one arm 2.1 of the second pair on the same side of a plane of symmetry containing the main axis and a thickness direction of the tongue 1 form with the portion of the central region 2.3 joining them a U-shape.

Each arm advantageously has:

an abutment 2.2 on its free end portion, which is also an end of a branch of said U-shape, ribs on its side facing towards the arm of the other pair, which is also the other branch of said U-shape.

The shape of the wall of the central region 2.3, which is also the base of the U-shape, matches 20 mm×30 mm rectangular cross-section bars or 20 mm×38 mm oval cross-section bars.

Perforations 2.6 in the central region 2.3 of the attachment element 2 enable insertion of a tool for mounting the bars, such as a screwdriver, an Allen key, etc.

A groove defining a thinner part 1.1 of the second end portion of the main leg 1.2 allows rotation by an angle $\alpha$ in a first sector of about 90° and by an angle $\beta$ in a second sector of about 90°, the second sector being symmetrical to the first sector relative to the plane of symmetry of the attachment device tongue, which plane of symmetry is orthogonal to the thickness direction of the latter. The first or angle $\alpha$ sector adjoins the side of the main leg 1.2 containing said groove. The second or angle $\beta$ sector adjoins the other side.

The groove is orthogonal to the thickness and to the main axis of the tongue 1. An alternative embodiment could have one or more grooves 1.1 on each side of the tongue without this departing from the scope of the invention. In the remainder of this description the thinner region 1.1 is assumed to comprise a single groove on a single side of the main leg 1.2 of the tongue 1.

An angle $\alpha$ or $\beta$ of 0° represents a "natural" position in which the thinner region 1.1 is not subjected to any shear stress. This is the position shown in FIGS. 1 and 2 in which the attachment element 2 is vertical, corresponding to a horizontal position of the bars 3 attached together by the attachment device.

An angle $\alpha$ of 90° represents a "use" position in which the thinner region 1.1 is subjected to low shear stresses: a disposition in which $\alpha$=90° closes up the thinner region 1.1. This is the position shown in FIG. 3 in which the attachment element 2 is horizontal, corresponding to a vertical position of the bars 3 attached together by the attachment device.

An angle $\beta$ of 90° represents a "shear" position in which the thinner region 1.1 is subjected to high shear stresses: a disposition in which $\beta$=90° distends the thinner region 1.1 so that the tongue 1 can be detached from the attachment element 2.

The attachment device 2 is molded in one piece from a plastics material. In a preferred embodiment of the invention the arms 2.1 and the central region 2.3 include grooves 2.5 to reduce the amount of material needed to manufacture said device.

To solve the technical problem of displaying bars in shelving units in stores, the invention also includes a shelving unit 4 specifically suited to the attachment device.

This linear shelving unit 4 has a vertical back 4.1 which is 133 cm wide on which are mounted a horizontal row of supports 4.2. The supports 4.2 are regularly spaced and the row comprises at least eleven supports. This row is about 190 cm above the floor, so that the labels of the bars suspended from them are at eye level for easy reading. The gap between two sets of bars hanging from adjacent supports is less than 5 cm.

The lower and less visible part of the shelving unit 4 can include drawers, shelves, brackets or the like 4.3 for storing bars 3 horizontally. The bars are usually about 120 cm long in their "stowed" position and about three shelves can be provided in the bottom 70 cm of the shelving unit for a horizontal arrangement.

The ends of the bars 3 are clipped between the arms 2.1 of the attachment device which have sufficient elasticity to grip the bars.

The detent effect of the abutment 2.2 on the arms 2.1 advantageously complements this pinching effect to hold the bars. The tongue 1 is turned through the angle $\alpha$ of 90° relative to the attachment element 2 so that it is parallel to the bars 3. The combination of the attachment device 1, 2 and the bars 3 is hooked onto a support 4.2 of the shelving unit by the eyelet 1.3 of the attachment device.

Although prior art shelving units 133 cm wide can display horizontally less than 32 pairs of bars of less than eight different kinds, the vertical display shelving unit of the invention can display at least 60 pairs of bars of at least 14 different types within a width of 133 cm.

There is claimed:

1. Device for attaching long objects, in particular bars, comprising an attachment element for attaching bars together and a tongue having hook means, wherein said element for attaching bars together includes four identical arms arranged in pairs at the ends of a central region, said arms of each pair extending in opposite directions along a common main axis and each pair of arms being parallel to each other, the distance between one arm of a first pair and one arm of a second pair being sufficient to grip with elasticity a bar between said one arm of first and second pairs, and wherein said tongue can rotate on said attachment element between a first use position wherein the main axis of the tongue is orthogonal to plan including said four arms and a second position wherein the main axis of the tongue extends in said plan.

2. Device according to claim 1, wherein each arm has a free end portion and an abutment on said end portion.

3. Device according to claim 1 wherein said tongue and said attachment element are in one piece.

4. Device according to claim 3 wherein said tongue is able to rotate relative to said attachment element by virtue of a thinner region of said tongue.

5. Device according to claim 1 wherein said hook means is an eyelet.

6. Device according to claim 5 wherein said eyelet is triangular in shape and the corners of said triangle are rounded, two of the three corners of said triangle being on a horizontal line when the device is hooked on, a third corner being under this horizontal line, on the main axis of said tongue, which is also a vertical axis in this position.

7. Device according to claim 6 wherein said horizontal side of said triangle includes a curved central portion with its concave side facing towards the interior of said triangle.

* * * * *